US011268265B2

(12) United States Patent
Whitelaw

(10) Patent No.: US 11,268,265 B2
(45) Date of Patent: Mar. 8, 2022

(54) BOOSTER PUMP AND BACKFLOW PREVENTER

(71) Applicant: Towle Whitney LLC, Hooksett, NH (US)

(72) Inventor: Dennis Whitelaw, Kennebunk, ME (US)

(73) Assignee: Towle Whitney LLC, Hooksett, NH (US)

( * ) Notice: Subject to any disclaimer, the term of this patent is extended or adjusted under 35 U.S.C. 154(b) by 0 days.

(21) Appl. No.: 16/885,942

(22) Filed: May 28, 2020

(65) Prior Publication Data

US 2021/0372095 A1 Dec. 2, 2021

(51) Int. Cl.

| | |
|---|---|
| ***F04D 13/14*** | (2006.01) |
| ***E03B 7/07*** | (2006.01) |
| ***E03B 5/02*** | (2006.01) |
| *E03B 7/04* | (2006.01) |

(52) U.S. Cl.

CPC ..... *E03B 7/077* (2013.01); *E03B 5/02* (2013.01); *E03B 7/04* (2013.01)

(58) Field of Classification Search

CPC ..... E03B 5/02; E03B 7/04; E03B 7/07; E03B 7/077; F04D 13/12; F04D 13/14; F04D 15/0005

See application file for complete search history.

(56) References Cited

U.S. PATENT DOCUMENTS

| | | | | |
|---|---|---|---|---|
| 2,692,607 | A | 10/1954 | Savage | |
| 4,371,315 | A * | 2/1983 | Shikasho | E03B 5/02 417/12 |
| 9,982,417 | B1 * | 5/2018 | Humble | F17D 1/14 |
| 2017/0159270 | A1 * | 6/2017 | Garg | E03B 11/14 |
| 2018/0093900 | A1 * | 4/2018 | Dickson | H02S 99/00 |
| 2018/0142450 | A1 * | 5/2018 | Oh | F04B 11/0091 |

OTHER PUBLICATIONS

[No Author Listed] Cross Talk: Undersizing Backflow Preventers. USC Foundation for Cross-Connection Control and Hydraulic Research, Mar. 23, 2005, 8 pages.

[No Author Listed] Design Envelope Booster Sequence of Operation. Armstrong. Mar. 23, 2015, 8 pages.

(Continued)

*Primary Examiner* — Paul J Gray

(74) *Attorney, Agent, or Firm* — Wolf, Greenfield & Sacks, P.C.

(57) ABSTRACT

Methods and systems of providing domestic water service to a commercial/residential building via a water booster pump assembly are disclosed herein. In some embodiments, the water booster pump assembly includes first and second water pipe branch circuits. In some embodiments, each water pipe branch circuit is configured with a backflow preventer and the water pipe branch circuits are fluidly coupled to one another in parallel. In some embodiments, the water pipe branch circuits are further coupled to one another via a crossover branch pipe configured to allow continuous flow through the two backflow preventers. Each water pipe branch circuit may include a pump. The crossover branch allows water to flow through both backflow preventers, even when one pump is inoperative.

21 Claims, 9 Drawing Sheets

(56) References Cited

OTHER PUBLICATIONS

[No Author Listed] Pentair Pentek® VFD-ALT Alternating Control Panel for the Pentek Intellidrive™, 1 page [publicly available at least as early as May 28, 2020].
[No Author Listed] TW2375T-200R-50 Gen-5: RPZ & VFD Booster Pump System, Towle Whitney Booster Pumps, 14 pages [publicly available at least as early as May 28, 2020].
[No Author Listed] TW2375T-200R-75 Gen-5: RPZ & VFD Booster Pump System, Towle Whitney Booster Pumps, 14 pages [publicly available at least as early as May 28, 2020].
[No Author Listed] TW2975-140R-60 Gen-5: RPZ & VFD Booster Pump System, Towle Whitney Booster Pumps, 14 pages [publicly available at least as early as May 28, 2020].
[No Author Listed] TW2975T-140R-40 Gen-5: RPZ & VFD Booster Pump System, Towle Whitney Booster Pumps, 14 pages [publicly available at least as early as May 28, 2020].
[No Author Listed] TW2975T-140R-80 Gen-5: RPZ & VFD Booster Pump System, Towle Whitney Booster Pumps, 14 pages [publicly available at least as early as May 28, 2020].
[No Author Listed] TW2975T-280R-50 Gen-5: RPZ & VFD Booster Pump System, Towle Whitney Booster Pumps, 14 pages [publicly available at least as early as May 28, 2020].
[No Author Listed] TW2975T-60R-40 Gen-5: RPZ & VFD Booster Pump System, Towle Whitney Booster Pumps, 14 pages [publicly available at least as early as May 28, 2020].
[No Author Listed] TW2975T-60R-65 Gen-5: RPZ & VFD Booster Pump System, Towle Whitney Booster Pumps, 14 pages [publicly available at least as early as May 28, 2020].
Whitelaw, 4 tips to mitigate legionella "harbors" in the mechanical room. Towle Whitney Booster Pump & Mixing Valve Systems, https://towle-whitney.com/4-tips-to-mitigate-legionella-harbors%e2%80%8b-in-the-mechanical-room/. May 6, 2020, 8 pages.
Whitelaw, Future of the mechanical room is the value-engineered gen-5. Towle Whitney Booster Pump & Mixing Valve Systems, https://towle-whitney.com/future-of-the-mechanical-room-is-the-value-engineered-gen-5/. Mar. 18, 2020, 6 pages.

* cited by examiner

| | Velocity in Backflow Preventer(s) (FPS) | | |
|---|---|---|---|
| Flowrate from 3'' Inlet (GPM) | First Configuration: One 2'' Backflow Preventer | Second Configuration: Two 2'' Backflow Preventers | Third Configuration: One 3'' Backflow Preventer |
| 20 | 2 | 1 | <1 |
| 25 | 2.5 | 1.3 | 1 |
| 50 | 5 | 2.5 | 2 |
| 100 | 10 | 5 | 4.5 |

FIG. 9

BOOSTER PUMP AND BACKFLOW PREVENTER

FIELD

Disclosed embodiments relate to a combination booster pump system and backflow prevention assembly (a.k.a. backflow preventer) for pressurizing water, for example, to provide domestic water service to a commercial/residential building.

BACKGROUND

To provide domestic water to a building, the building's mechanical room may be equipped with a booster pump assembly. However, if the booster pump system experiences a pressure loss, for example due to a break of a water source pipe, water may flow through the system in reverse, contaminating the water supply. To mitigate such contamination, most water suppliers require a building to be equipped with a backflow preventer. The mechanical room of a building may be configured with multiple backflow preventers for redundancy. However, the flow of water in such systems may be unpredictable, and thus, water flow may stagnate in one or more of the backflow preventers. When water flow stagnates within one or more backflow preventers pathogen harbors may accumulate within the backflow preventer.

BRIEF SUMMARY

According to one embodiment, a water booster pump apparatus includes a water inlet pipe, a water outlet pipe, a first water pipe branch circuit, and a second water pipe branch circuit. The first water pipe branch circuit is fluidly coupled to the water inlet pipe and the water outlet pipe. The first water pipe branch circuit may include, in series, a first backflow preventer and a first booster pump. The second water pipe branch circuit is fluidly coupled to the water inlet pipe, and the second water pipe branch circuit includes, in series, a second backflow preventer and a second booster pump. The first and second water pipe branch circuits are arranged in parallel with each other and each is disposed between the water inlet pipe and the water outlet pipe. A crossover branch fluidly couples the first and second branch circuits at a position downstream of the first and second backflow preventers and upstream of the first and second booster pumps.

According to another embodiment, a method of boosting water is disclosed. The method includes pumping water through a first water pipe branch circuit fluidly coupled to a water inlet pipe and a water outlet pipe, the first water pipe branch circuit including a first backflow preventer. The method further includes pumping the water through a second water pipe branch circuit fluidly coupled to the water inlet pipe and the water outlet pipe, the second water pipe branch circuit including a second backflow preventer. The method also includes balancing a flow of the water through the first backflow preventer and the second backflow preventer such that a volumetric flow rate of the water through the first backflow preventer is substantially equal to a volumetric flowrate of the water through the second backflow preventer.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings:

FIG. 9 is a table showing an approximation of the velocity of water flowing through one or more backflow preventers in three exemplary configurations.

DETAILED DESCRIPTION

Figure 1:
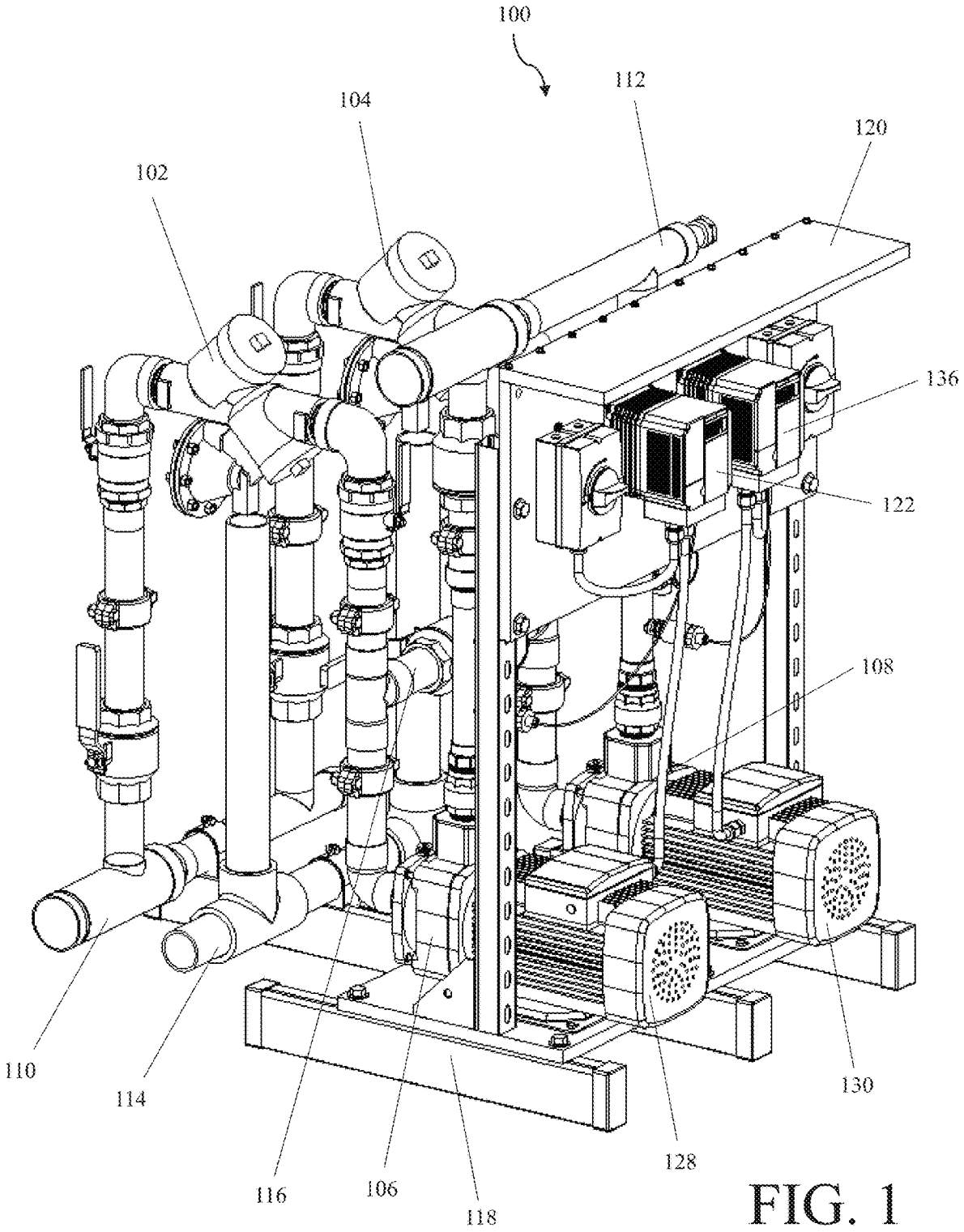
FIG. 1 is a perspective view of an embodiment of a water booster pump apparatus.

Generally speaking, a booster pump and backflow preventer assembly may be commonly used in a commercial building's mechanical room to pressurize water to meet the water demands of the commercial building. One or more booster pumps may provide water throughout a commercial building, while one or more backflow preventers may allow water to only flow in one direction, from an inlet connected to a water source pipe towards an outlet connected to a water supply pipe.

Conventional backflow preventers allow water to only flow in one direction, from the water source pipe towards the water supply pipe. In other words, a backflow preventer may stop water from flowing in a direction opposite to the intended flow direction. When the pressure within the booster pump and backflow preventer system changes, for example, due to a break in the water source pipe, water may attempt to flow from the water supply pipe towards the water source pipe, however, the backflow preventer will stop the water from reaching the water source pipe. In the absence of a backflow preventer, water backflow may contaminate the water supply. Thus, a backflow preventer may help prevent the contamination of the water supply.

The mechanical room of a building may contain two or more backflow preventers. However, water does not necessarily flow through the two or more backflow preventers in a consistent or predictable manner. Thus, this no-flow or slow-flow scenario may cause water to stagnate within at least one backflow preventer, resulting in pathogen harbors within the backflow preventer, which can lead to the buildup of harmful diseases such as legionellae.

In view of the above, the Inventor has recognized the advantages of a water booster pump system capable of maintaining a consistent water flow through each of the backflow preventers in a water booster pump system. The Inventor discovered that such a flow may scrub each backflow prevent of any potential pathogen harbors.

Embodiments of the present disclosure include a water booster pump assembly adapted to pump water from an inlet through two or more backflow preventers towards an outlet. According to an aspect of the present disclosure, the water booster pump assembly includes a crossover branch pipe or crossover/bypass manifold configured to allow water flow continuously through a first and second backflow preventer.

In some embodiments, the water booster assembly includes a water inlet pipe that feeds a first water pipe branch circuit. The first water pipe branch includes a first backflow preventer fluidly coupled to a first booster pump. In some embodiments, the first backflow preventer is fluidly coupled to the first booster pump in a single flow path (i.e. in series). Thus, water may travel from the water inlet pipe through the first backflow preventer, then through the first booster pump towards a water outlet pipe. In some embodiments, the water inlet pipe is fluidly coupled to a water source pipe and the water outlet pipe is fluidly coupled to a water supply pipe. Both the water source pipe and the water outlet pipe may be pre-existing in the building's mechanical room.

Moreover, in some embodiments, the water inlet pipe feeds a second water pipe branch circuit of the water booster assembly. The second water pipe branch circuit includes a second backflow preventer fluidly coupled to a second booster pump in a single flow path (i.e. in series). Thus, water may travel from the water inlet pipe through the second backflow preventer, then through the second booster pump towards a water outlet pipe. In some embodiments, the water inlet pipe is fluidly coupled to a water source pipe and the water outlet pipe is fluidly coupled to a water supply pipe.

In some embodiments, the water inlet pipe feeds water through both the first water pipe branch circuit and the second water pipe branch circuit simultaneously. Further, the outlet pipe is configured to receive water from one or both of the first and second booster pumps. Thus, in such embodiments, water traveling from the inlet to the outlet may take one of two possible flow paths. In other words, the first and second water pipe branch circuits may be connected to one another in parallel.

In some embodiments, the first and second water pipe branches are connected in parallel and include a crossover branch pipe. In some embodiments, the crossover branch pipe is disposed downstream of the first and second backflow preventers and upstream of the first and second booster pumps. Thus, the crossover branch pipe allows water to flow through both the first and second backflow preventers when flowing from the water inlet pipe towards the water outlet pipe, regardless of which of the first and second pumps are active.

In some embodiments, the water booster pump assembly is capable of balancing flow within the first and second backflow preventers. For example, the crossover branch pipe is configured to balance the volumetric flowrate of water through the first and second backflow preventers. Thus, as one or both of the first and second pumps drive water from the water inlet pipe towards the water outlet pipe, flow continues through both the first and second backflow preventers. In some embodiments, the crossover manifold is configured to allow the flow rate of water through the first backflow preventer to be substantially the same as the flow rate of water through the second backflow preventer.

Alternatively, in some embodiments, a water booster pump assembly includes three or more backflow preventers. In such embodiments, the water booster pump assembly includes two or more crossover branch pipes. For example, in an embodiment containing three backflow preventers in three separate water pipe branch circuits, a first crossover branch pipe connects the first and second water pipe branch circuits and a second crossover branch pipe connects the second and third water pipe branch circuits. In some embodiments, the three water pipe branch circuits are configured with a backflow preventer and booster pump as described above. As will be appreciated, in embodiments with more than three water pipe branch circuits, a number of crossover branch pipes equal to one fewer than the number of water pipe branches is employed.

In some embodiments, the water booster pump assembly is configured with first and second backflow preventers that are undersized relative to the water inlet pipe. For example, the backflow preventers may be configured with a smaller size rating than that of the water inlet pipe. A pipe with a smaller size rating may have a smaller cross sectional transverse dimension than a pipe with a larger size rating. In some embodiments, the cross section of the pipe is circular, and the transverse dimension is a diameter. As will be appreciated, in such embodiments, the flow rate of water through the undersized backflow preventers is greater than the flow rate of water through the water inlet pipe.

A conventional system using an undersized backflow preventer may prematurely wear relative to a fully sized backflow preventer due to the increased flowrate in the undersized backflow preventer. Thus, the Inventor has recognized the advantages of a system employing balanced water flow through two or more backflow preventers. For example, in some embodiments, a single water inlet pipe feeds water to the first and second undersized backflow preventers, which decreases the flowrate in each backflow preventer relative to a conventional system with a single undersized backflow preventer. Thus, a system feeding two undersized backflow preventers from a single water inlet pipe mitigates the risk of premature wear of the two or more undersized backflow preventers.

In some embodiments, the increased flowrate through the backflow preventers serves to scrub the backflow preventers of pathogen harbors, including the buildup of diseases such as legionellae.

Additionally, some conventional systems provide water using a single pump running continuously. Such pumps may prematurely fail, as the pump is under a constant load. Moreover, under periods of high water demand, a single pump may not have the capability to provide the water pressure required to boost water to the building (i.e. "high demand"). Thus, two booster pumps may be used in tandem to so that a second booster pump may compensate for the lack of capability of the first booster pump. Oftentimes, one pump is used as a primary or "lead" pump and the other is used as secondary or "lag" pump. However, systems with a predominantly inactive booster pump may suffer from the buildup of pathogen harbors, which may include diseases such as legionellae.

In view of the above, the Inventor has recognized the advantages of a water booster pump system that uses two or more booster pumps with the capability of alternating the status of the pumps between "lead" and "lag" status. In some embodiments, a pump is on when it is in "lead" status and off when it is in "lag" status.

In some embodiments, a water booster pump assembly with two booster pumps includes a first controller and a second controller, wherein the first controller is dedicated to the first booster pump and the second controller is dedicated to the second booster pump. The two controllers are networked together by means of a communication wire, thus allowing the two controllers to share data. Initially, the first controller and the first booster pump are the lead, and the second controller and the second booster pump are in standby, also known as the lag. The controllers communicate, according to a predetermined schedule, for example every 24 hours, and the second controller and the second booster pump become the lead. The first controller and the first booster pump then switch to the lag. As will be appreciated by one of skill in the art, a single controller may be used to carry out the functionality described above, wherein the single controller operates both pumps.

In some embodiments, the alternating of lead pumps causes water to flow through all of the piping, thus eliminating any buildup of stagnant water.

For example, in some embodiments, the flow from the first backflow preventer joins flow from second backflow preventer via the crossover branch pipe and on to the second booster pump (which is now acting as the "lead" pump).

It should be appreciated that while the previously discussed embodiments include a controller configured to alternate the status of the booster pumps every 24 hours, other time intervals are contemplated. For example, the controller may be configured to cycle the pumps every 6 hours, 12 hours, 18 hours, or any other suitable time period.

In some embodiments, the controller provides at least three modes of operation, two modes directed to managing flow under normal demand (wherein a single pump may provide sufficient water pressure to meet a building's water needs) and one mode directed to managing flow under high demand (wherein a single pump cannot to provide sufficient water pressure to meet a building's water needs). During a first mode of operation, the first booster pump is set to an "on" or "lead" status and the second booster pump is set to an "off" or "lag" status. During the first mode of operation, water flows from the water inlet pipe through both the first and second backflow preventers and the first booster pump. In the first mode of operation, the flow from second backflow preventer joins flow from first backflow preventer via the crossover branch pipe and on to the first booster pump (which is now acting as the "lead" pump).

During a second mode of operation, the first booster pump is set to an "off" or "lag" status and the second booster pump is set to an "on" or "lead" status. In the second mode of operation, water flows from the water inlet pipe through both the first and second backflow preventers and the second booster pump. In the second mode of operation, the flow from the first backflow preventer joins flow from second backflow preventer via the crossover branch pipe and on to the second booster pump (which is now acting as the "lead" pump).

At times, the lead pump may not be able to maintain the desired pressure, and will communicate with the lag pump to ramp up and provide additional capacity. In such a case, the water booster pump assembly may enter a third mode of operation. During a third mode of operation, both pumps are set to an "active" status, and water flows from the water inlet pipe through both the first and second backflow preventers with little or no flow through the crossover branch pipe. When both pumps are in the "active" status, in some embodiments, both pumps provide about equal water flow. For example, under high demand, if a building requires 120% of a pump's capacity, both pumps will enter an "active" status and each operate at about 60% capacity. In the third mode of operation, little water may be moving through the crossover bypass manifold.

Thus, the process of cycling each pump on and off, as described above, decreases the infrequent use of booster pumps in a water booster pump assembly by cycling the use of the booster pumps according to a predetermined schedule. Accordingly, water flow through each booster pump scrubs pathogen harbors in the booster pumps by flowing through each pump according to a consistent schedule.

In some embodiments, the crossover bypass manifold includes a shut-off valve for the purpose of isolating each pump for maintenance. When the valve is shut, all of the water will travel through either one of the first or second backflow preventers directly to the operating pump.

Conventional water booster pump assemblies must be built from a plethora of different parts. For example, a contractor may need to acquire one or more separate backflow preventers, one or more separate pumps, and/or one or more separate piping segments, among other components. Systems built in this fashion tend to not only take up significant space in a mechanical room but also are time consuming to construct on-site.

In view of the above, the Inventor has recognized the advantages of mounting each of the components of the water booster pump assembly on a single, compact frame. Thus the water booster pump assembly can be produced and sold as a single unit assembled on the frame. Accordingly, the water booster pump assembly may be sold as a single SKU. A water booster pump assembly sold under a single SKU may be individually tested under regulatory requirements as a single unit, rather than having to test each component separately.

Of course, it should be appreciated that rather than being mounted on a frame, the components may be packaged together as a kit, including each component of the water booster pump assembly.

In some embodiments, the frame includes a hood that may cover electrical components of the water booster pump assembly, such as the controller. In some embodiments, the hood is permanently fixed to the frame. However, it should be appreciated that embodiments with a removable hood are also contemplated.

In some embodiments, the backflow preventers are fluidly coupled to a drain system. The drain system may be used to manually remove water from the relief valves of the backflow preventers.

In view of the above, further combinations of the features previously discussed are also contemplated. For example, additional embodiments may include a water booster pump assembly containing a crossover manifold with undersized backflow preventers mounted on a frame; a water booster pump assembly containing a crossover manifold with a controller designed to cycle the operation of the pumps with undersized backflow preventers mounted on a frame; and/or a water booster pump assembly containing a crossover manifold mounted on a frame with undersized backflow preventers. Of course, additional combinations of the above features are also contemplated.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 2:
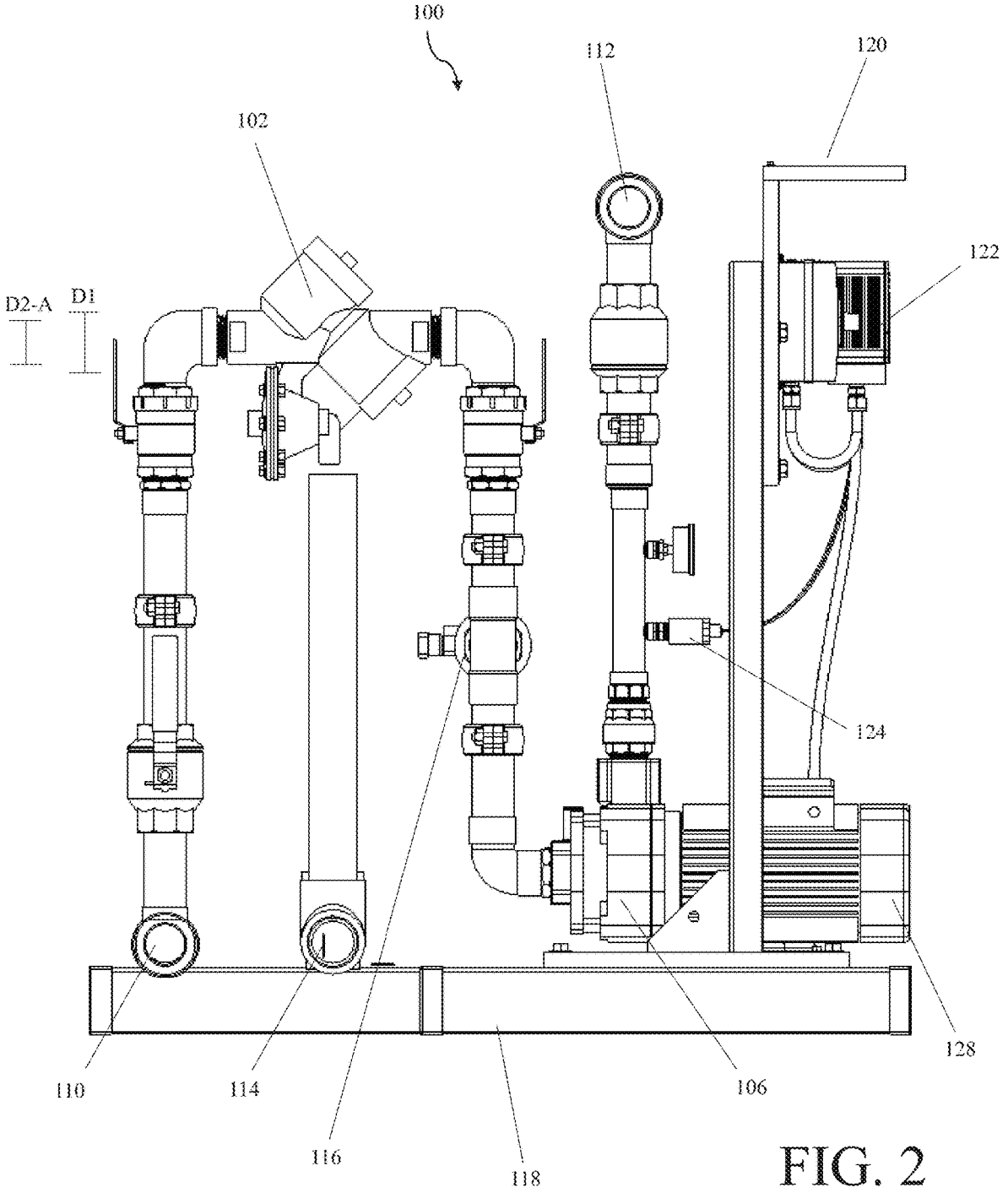
FIG. 2 is a left side view of FIG. 1.
Figure 3:
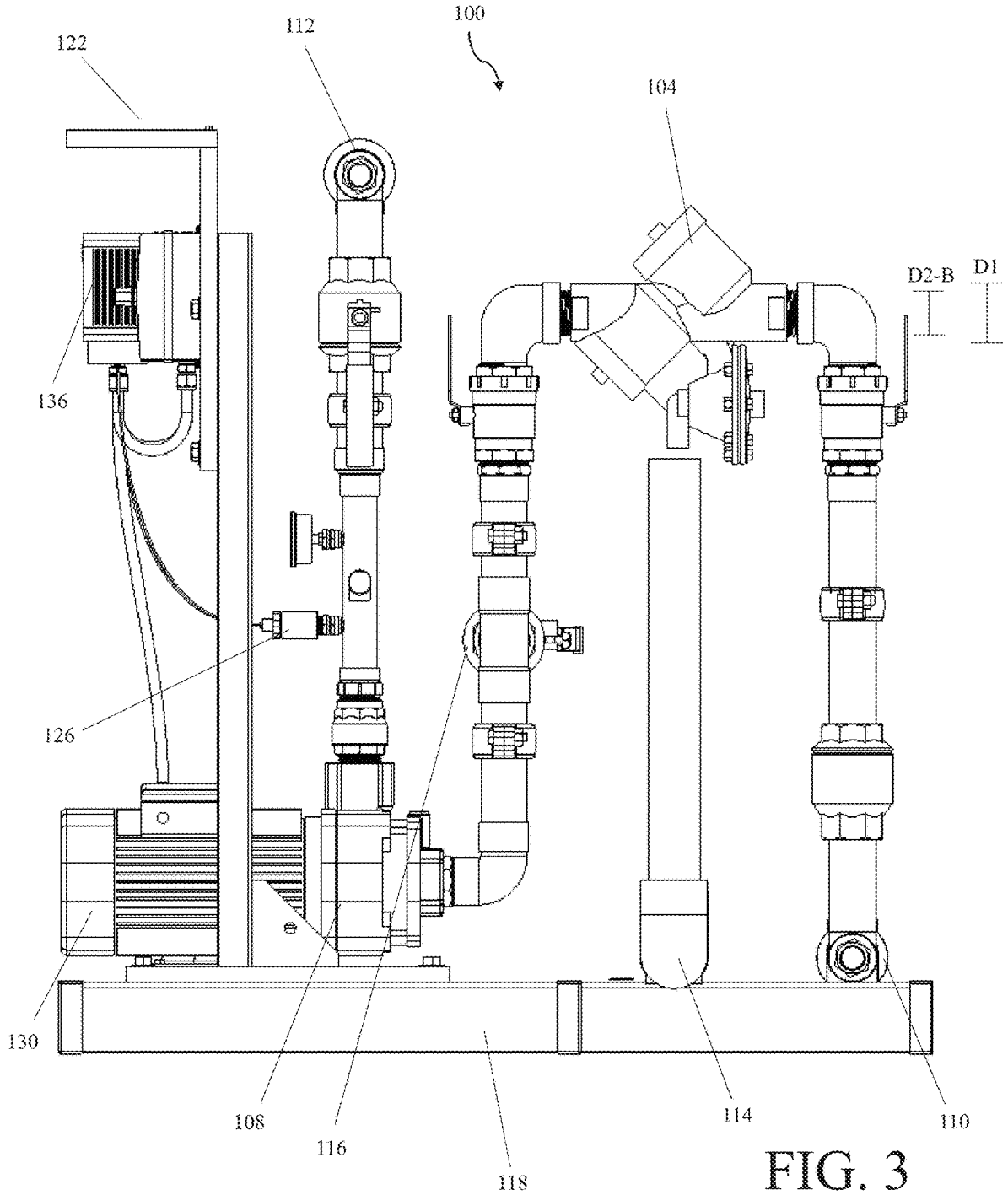
FIG. 3 is a right side view of FIG. 1.
Figure 4:
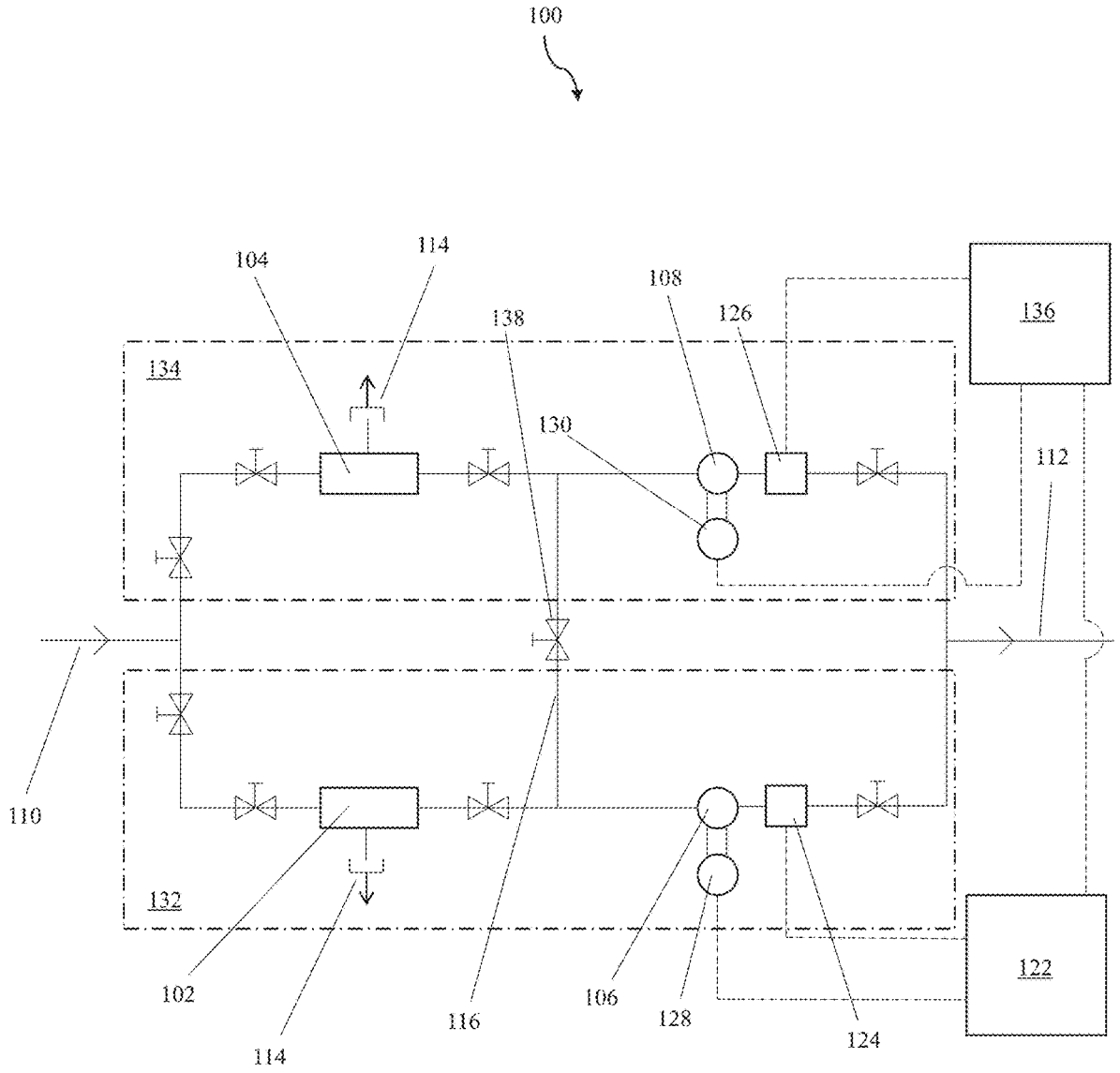
FIG. 4 is a schematic view of the water booster pump apparatus.

FIGS. 1-3 are various views of a water booster pump assembly 100, and FIG. 4 is a schematic view of the water booster pump assembly 100. As shown in these figures, in some embodiments, water booster pump assembly 100 includes a water inlet pipe 110, which receives water from a water source pipe. Such a water source pipe could be a municipal water service, a private well or a water reservoir or tank, as the present disclosure is not limited in this respect. As shown in FIG. 4, water inlet pipe 110 feeds water into a first water pipe branch circuit 132 and second water pipe branch circuit 134. First water pipe branch circuit 132 includes a first backflow preventer 102 and a first booster pump 106. In some embodiments, first booster pump 106 is disposed downstream of first backflow preventer 102, and water flows along a single path from first backflow preventer 102 towards first booster pump 106. Thus, first backflow preventer 102 and first booster pump 106 are fluidly coupled in series. Similarly, second water pipe branch circuit 134 includes a second backflow preventer 104 and a second booster pump 108. In some embodiments, second booster pump 108 is disposed downstream of second backflow preventer 104, and water flows along a single path from second backflow preventer 104 towards second booster pump 108. Thus, second backflow preventer 104 and second booster pump 108 are fluidly coupled in series.

First backflow preventer 102 allows water to flow in only one direction, from a water inlet pipe 110 towards a water outlet pipe 112, stopping the water from flowing in an opposite direction. Specifically, first booster pump 106 causes water to flow from water inlet 110 towards water outlet 112. However, if the flow in first water pipe branch circuit 132 changes, for example in the event of a break in any of the water supply lines downstream of the first backflow preventer or a malfunctioning booster pump, water may attempt to flow towards water inlet pipe 110. However, under such circumstances, first backflow preventer 102 will stop water from flowing back to water inlet pipe 110. First backflow preventer 102 may achieve this functionality by using one or more check valves, hydraulic relief valves, or any other suitable configuration, as will be appreciated by one of skill in the art.

Similarly, second backflow preventer 104 allows water to flow in only one direction, from a water inlet pipe 110 towards a water outlet pipe 112, stopping the water from flowing in an opposite direction. Specifically, second booster pump 108 causes water to flow from water inlet 110 towards water outlet 112. However, if the flow in second water pipe branch circuit 134 changes, for example in the event of a break in any of the water supply lines downstream of the second backflow preventer or a malfunctioning booster pump, water may attempt to towards water inlet pipe 110. However, under such circumstances, second backflow preventer 104 will stop water from flowing back to water inlet pipe 110. Like the first backflow preventer 102, second backflow preventer 104 may achieve this functionality by using one or more check valves, hydraulic relief valves, or any other suitable configuration.

It should be appreciated that since first and second backflow preventers 102, 104 stop water from flowing towards inlet 110, first and second backflow preventers 102, 104 may retain a volume of water or may be blocking a volume of flow downstream of the backflow preventer. Thus, first and second backflow preventers 102, 104 may contain a drain 114 to allow for the retained water to be removed from first and second backflow preventers 102, 104 and/or the volume of water in the pipes downstream of the backflow preventer. Water may also be removed via the backflow preventers 102, 104 via drain 114 prior to maintenance, repair, or cleaning.

First water pipe branch circuit 132 and second water pipe branch circuit 134 may be fluidly connected via at least inlet pipe 110 and outlet pipe 112. Accordingly, water from inlet pipe 110 may travel along one of two flow paths, either along first water pipe branch circuit 132 or along second water pipe branch circuit 134. Thus, first water pipe branch circuit 132 and second water pipe branch circuit 134 are connected in parallel. First water pipe branch 132 and second water pipe branch 134 may be further fluidly coupled via a crossover branch pipe 116. Crossover pipe branch 116 allows water to travel through both first and second backflow preventers 102, 104 regardless of whether first booster pump 106 or second booster pump 108 is in operation. For example, when first booster pump 106 is on ("lead") and second booster pump 108 is off ("lag"), crossover branch pipe 116 allows water to flow from second backflow preventer 104 disposed in second water pipe branch circuit 134 into first water pipe branch circuit 132 before flowing through first pump 106 and outlet pipe 112. Similarly, when second booster pump 108 is on ("lead") and first booster pump 106 is off ("lag"), crossover branch pipe 116 allows water to flow from first backflow preventer 102 disposed in first water pipe branch circuit 132 into second water pipe branch circuit 134 before flowing through second pump 108 and outlet pipe 112.

In some embodiments, water booster pump assembly 100 includes features that increase the flowrate of water through first and second backflow preventers 102, 104. For example, in some embodiments, backflow preventers 102, 104 are undersized as compared to water inlet pipe 110. As will be appreciated, undersizing first and second backflow preventers 102, 104 increases the flowrate of water through first and second backflow preventers 102, 104.

FIGS. 2-3 show an embodiment of water booster pump assembly 100 with undersized backflow preventers 102, 104. For example, as shown in FIG. 2, water inlet pipe 110 is configured with a first diameter, represented as D1, and first backflow preventer 102 is configured with a second diameter, represented as D2-A, wherein D1 is greater than D2-A. Similarly, as shown in FIG. 3, water inlet pipe 110 is configured with a first diameter, represented as D1, and second backflow preventer 104 is configured with a second diameter, represented as D2-B, wherein D1 is greater than D2-B. In some embodiments, diameter D2-A of the first backflow preventer 102 equals diameter D2-B of the second backflow preventer 104.

For example, FIG. 9 is a table showing the velocity of water, in feet per second, flowing through one or more backflow preventers in three different possible configurations. In the first configuration, a 3 inch water inlet pipe feeds a single 2 inch backflow preventer. This is an undersized configuration and typically would not be employed. In the second configuration, a three inch water inlet pipe feeds a pair of 2 inch backflow preventers with balanced flow (due to a crossover branch pipe, for example). In the third configuration, a 3 inch water inlet pipe feeds a single 3 inch backflow preventer. This is a line-sized configuration (i.e., without the use of a crossover pipe as in existing systems).

Thus, assuming in one embodiment, water inlet pipe 110 has a diameter of 3 inches and first and second backflow preventers 102, 104 are sized for a 2 inch diameter installation (second configuration). In such an embodiment, if water flows through water inlet pipe 110 at a rate of 20 gallons per minute, the water will flow through both backflow preventers 102, 104 at a velocity of 1 foot per second. Comparatively, in a system including only a single 3 inch-sized backflow preventer fluidly coupled to a 3 inch water inlet pipe (third configuration), water will flow through the backflow preventer at a velocity of less than 1 foot per second.

Continuing with this illustrative embodiment, if water flows through water inlet pipe 110 at a rate of 25 gallons per minute, the water will flow through both backflow preventers 102, 104 at a velocity of 1.3 feet per second. Comparatively, in a system including only a single 3 inch-sized backflow preventer fluidly coupled to a 3 inch water inlet pipe (third configuration), water will flow through the backflow preventer at a velocity of 1 foot per second.

Again, continuing with this illustrative embodiment, if water flows through water inlet pipe 110 at a rate of 50 gallons per minute, the water will flow through both backflow preventers 102, 104 at a velocity of 2.5 feet per second. Comparatively, in a system including only a single 3 inch-sized backflow preventer fluidly coupled to a 3 inch water inlet pipe (third configuration), water will flow through the backflow preventer at a velocity of 2 feet per second.

Continuing still with this illustrative embodiment, if water flows through water inlet pipe 110 at a rate of 100 gallons per minute, the water will flow through both backflow preventers 102, 104 at a velocity of 5 feet per second. Comparatively, in a system including only a single 3 inch-sized backflow preventer fluidly coupled to a 3 inch water inlet pipe (third configuration), water will flow through the backflow preventer at a velocity of 4.5 feet per second.

Thus, it follows that water may flow through two undersized backflow preventers at a faster velocity than a single line-sized backflow preventer, mitigating the buildup of pathogen harbors in each of the undersized backflow preventers. However, the water flow through each of the backflow preventers is not as high as a single undersized backflow preventer so as to otherwise induce premature wear of the backflow preventer.

Figure 5:
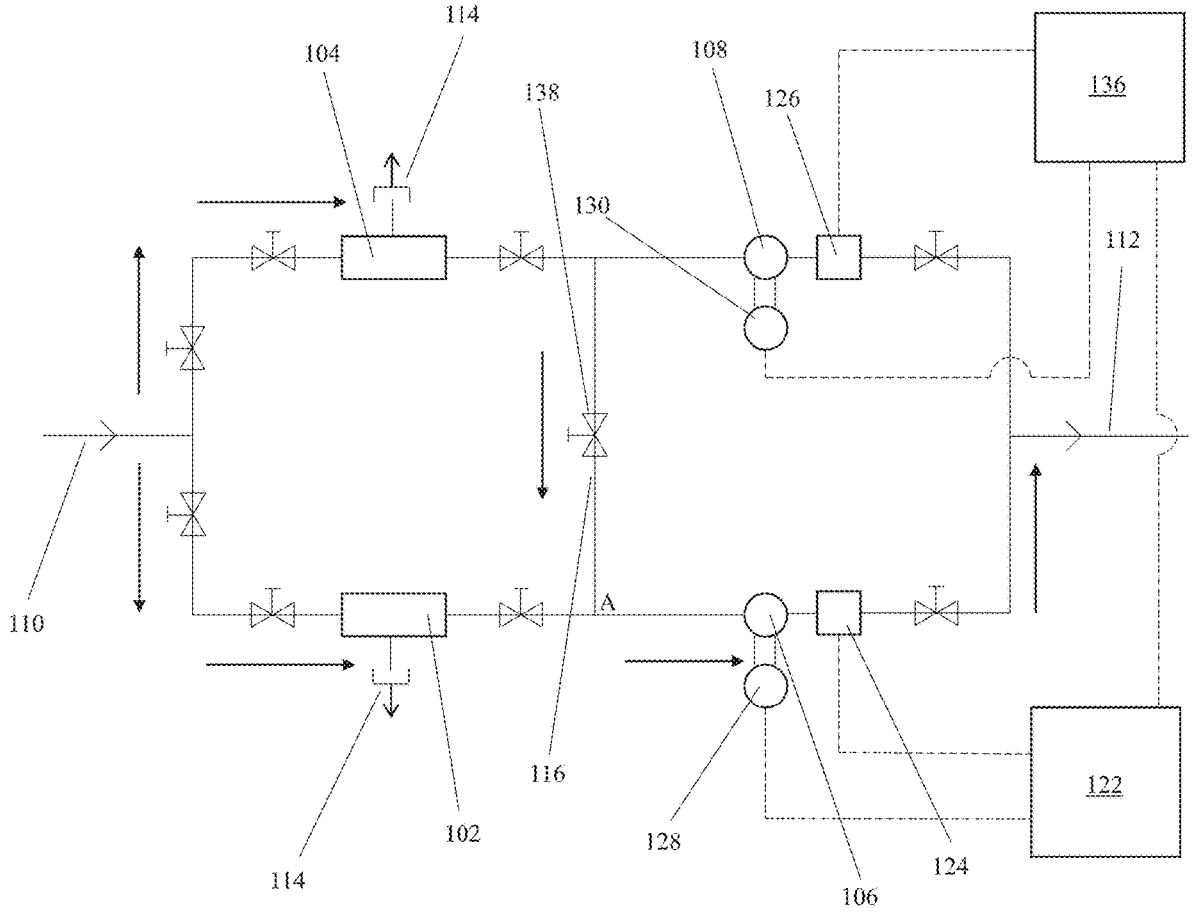
FIG. 5 is a schematic view of the water booster pump apparatus of FIG. 4 while the first pump is the lead pump.

In some embodiments, water booster pump assembly 100 includes features that allow a first controller 122 and a second controller 136 to cycle the operation of first and second booster pumps 106, 108. For example, FIG. 5 shows an embodiment in which first controller 122 and second controller 136 communicate via a wired connection. In this embodiment, first controller 122 is operating first pump 106 as the lead booster pump and controller 136 is operating second pump 108 as the standby ("lag"). As water flows from inlet 110, the water divides evenly, flowing through first and second backflow preventers 102 and 104. Accordingly, a first portion of the flow enters first water branch circuit 132 and a second portion of the flow enters second water pipe branch circuit 134. After passing through second backflow preventer 104, the portion of water in second water branch circuit 134 travels from second water pipe branch circuit 134 to first water branch circuit 132 via crossover branch pipe 116. Thus, the portion of water originally flowing through second water pipe branch circuit 134 joins with the water flowing through first water pipe branch circuit 132 at point A. The water then flows through first water booster pump 106 towards water outlet pipe 112.

Figure 6:
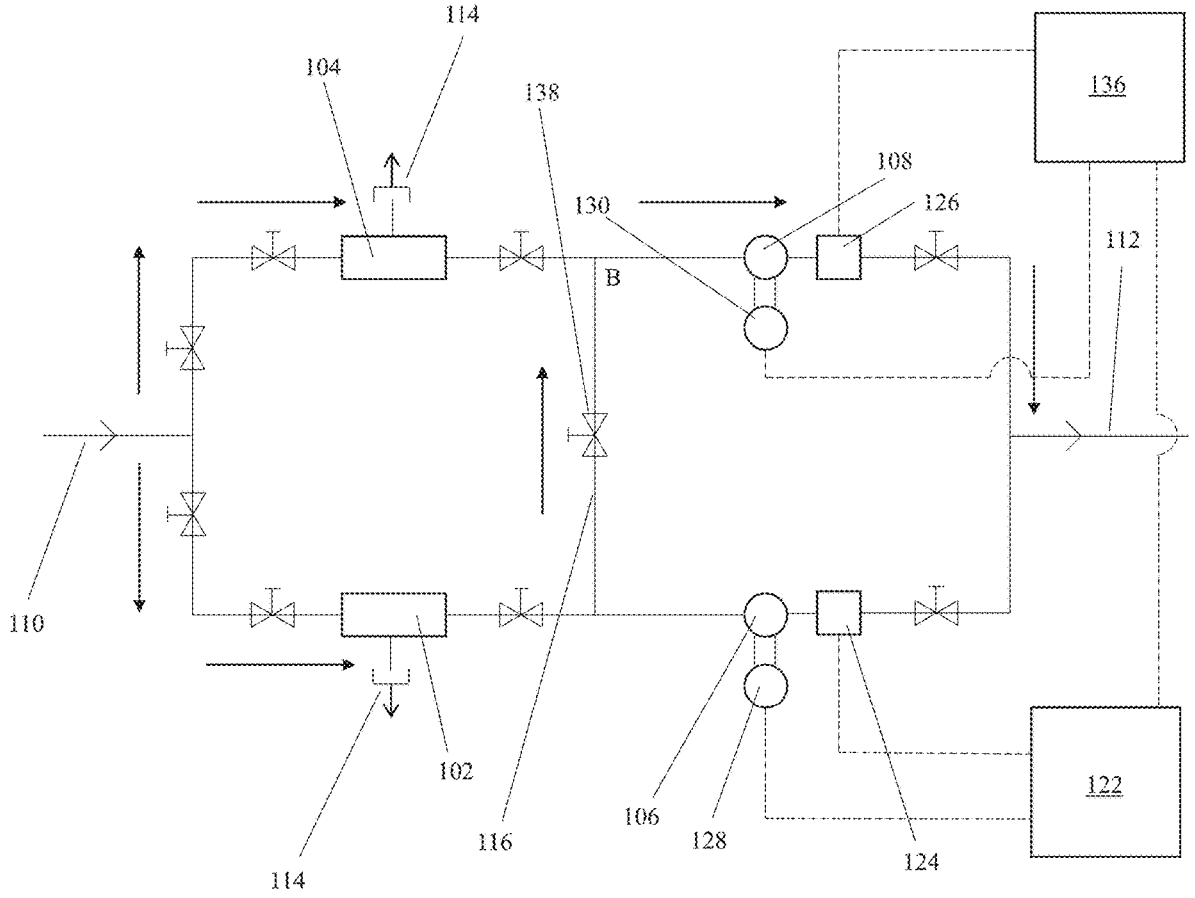
FIG. 6 is a schematic view of the water booster pump apparatus of FIG. 4 while the second pump is the lead pump.

FIG. 6 shows an embodiment in which controllers 122, 136 are operating water booster pump apparatus 100 such that second pump 108 is the lead and first pump 106 is in standby ("lag"). As water flows through inlet 110, water flows evenly towards first and second backflow preventers 102 and 104. Accordingly, a first portion of the flow enters first water branch circuit 132 and a second portion of the flow enters second water pipe branch circuit 134. After passing through first backflow preventer 102, the portion of water in first water pipe branch circuit 132 travels from first water pipe branch circuit 132 to second water branch circuit 134 via crossover branch pipe 116. Thus, the portion of water originally flowing through first water pipe branch circuit 132 combines with the water flowing through second water pipe branch circuit 134 at point B. The water then flows through second water booster pump 108 towards water outlet pipe 112.

Figure 7:
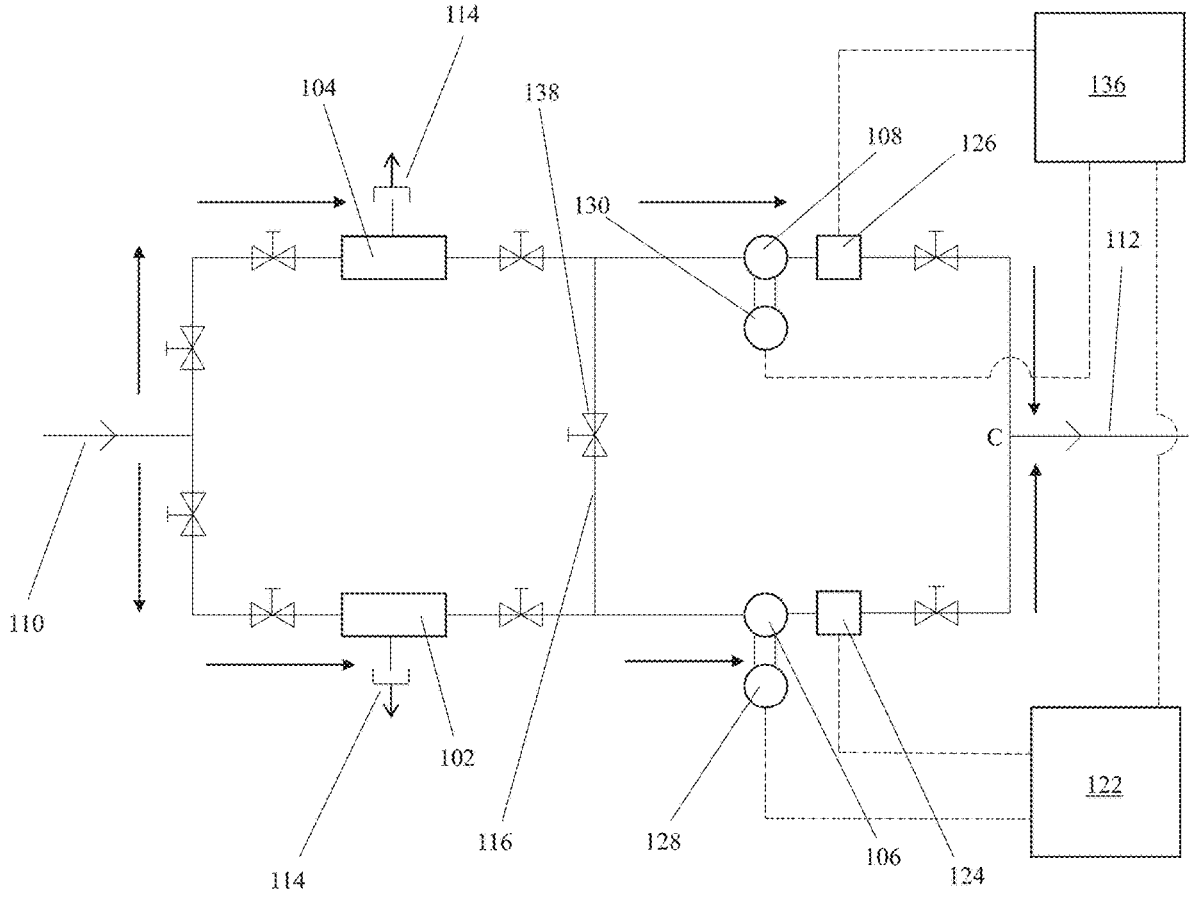
FIG. 7 is a schematic view of the water booster pump apparatus of FIG. 4 while both pumps are operating.

Controllers 122, 136 may also operate both booster pumps 106, 108 together, wherein both first and second booster pumps 106, 108 are simultaneously active, as shown in FIG. 7. In such an embodiment, as water flows through inlet 110, a first portion of the water travels through first water pipe branch circuit 132 and a second portion of the water flows though second water pipe branch circuit 143. After flowing through first and second backflow preventers 102, 104 respectively, the first and second water portions flow through first and second booster pumps 106, 108 respectively. Then, both portions of water meet in outlet 112 at point C. The water may then flow through outlet 112 and into a supply pipe.

In some embodiments, under normal demand, first controller 122 operates first booster pump 106 as the lead pump according a predetermined schedule. In some embodiments, first controller 122 initially sets first pump 106 to "on" or "lead" status, and second controller 136 sets second pump 108 to "off" or "lag" status. First controller 122 will then operate booster pump 106 for a predetermined time interval, such as 24 hours. Next, first controller 122 sets booster pump 106 to "off" or "lag" status, and second controller 136 sets second booster pump 108 to "on" or "lead" status. Second controller 136 then operates second booster pump 108 for a predetermined time interval, such as 24 hours. It should be appreciated that a number of possible predetermined time intervals are contemplated, including time intervals such as 6, 12, or 16 hours. Other time intervals are also possible, including time intervals of fewer than 6 hours, greater than 24 hours, between 6 and 12 hours, and between 12 and 16 hours.

Additionally, controllers 122, 136 may operate water booster pump apparatus 100 in a mode of operation when both pumps are active to support the domestic water service requirements of a building that exceed the capabilities of either first or second booster pumps 106, 108 individually.

Figure 8:
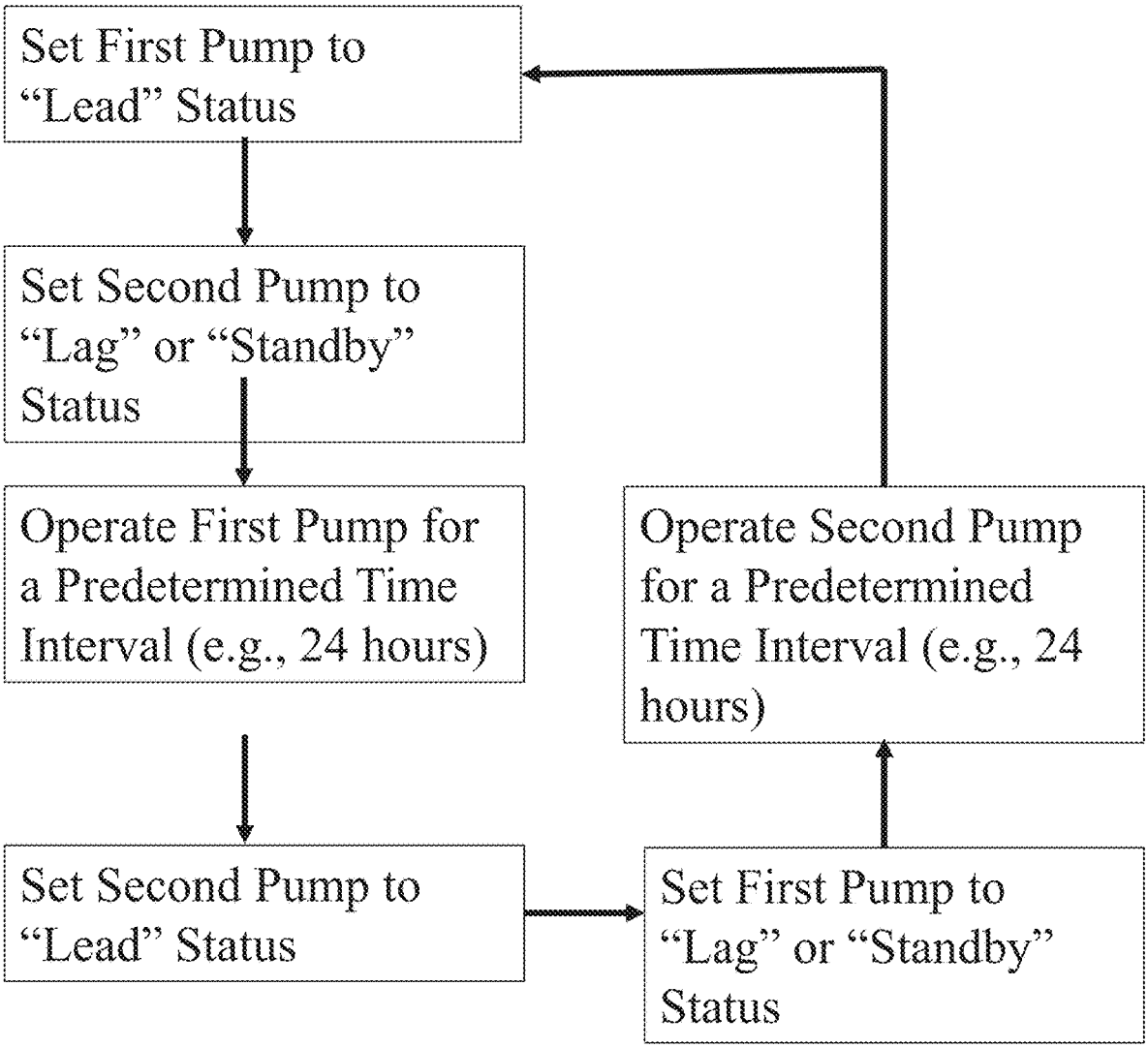
FIG. 8 illustrates a method of alternating the lead pump of the water booster pump apparatus according to some embodiments.

In some embodiments, the disclosure is embodied as a method of operating first and second pumps 106, 108 according a predetermined schedule, the steps of which are outlined in FIG. 8. In some embodiments, the method includes initially setting first pump 106 to "on" or "lead" status and second pump 108 to "standby" or "lag" status. Then, first pump 106 is operated for a predetermined time interval, such as 24 hours. Next, first pump 106 is set to "standby" or "lag" status, and second pump 108 may be set to "on" or "lead" status. Second pump 108 may then be operated for the predetermined time interval, such as 24 hours. It should be appreciated that a number of possible predetermined time intervals are contemplated, including time intervals such as 6, 12, or 16 hours. Other time intervals are also possible, including time intervals of fewer than 6 hours, greater than 24 hours, between 6 and 12 hours, and between 12 and 16 hours.

In some embodiments, downstream of backflow preventer 102, first pump 106 includes a first sensor 124 and a first motor 128, as shown in FIG. 4. First sensor 124 and first motor 128 are connected to a controller 122, which is configured to activate or deactivate first booster pump 106. Further, first sensor 124 electronically communicates with controller 122 to relay information regarding first booster pump 106, such as whether first booster pump 106 is on or off, the volumetric flow rate of water through first booster pump 106, an operation time of first booster pump 106, or any other suitable information.

Similarly, in some embodiments, second pump 108 includes a second sensor 126 and a second motor 130. Second sensor 126 and second motor 130 are connected to controller 122, which is configured to activate or deactivate second booster pump 108. Further, second sensor 126 electronically communicates with controller 122 to relay information regarding second booster pump 108, such as whether second booster pump 108 is on or off, the volumetric flow rate of water through second booster pump 108, an operation time of second booster pump 108, or any other suitable information.

As shown in FIGS. 4-7, in some embodiments, crossover bypass manifold 116 includes a shut-off valve 138 for the purpose of isolating each pump and/or backflow preventer for maintenance. When shut-off valve 138 is closed, all of the water will travel through first backflow preventer 102 when first booster pump 106 is active. Thus, when first booster pump 106 is active and shut-off valve 138 is closed, shut-off valve 138 prevents water from flowing though second backflow preventer 104, allowing a technician to maintain or test first pump 106 and first backflow preventer 102. Also, when shut-off valve 138 is closed, all of the water will travel through second backflow preventer 104 when second booster pump 108 is active. Thus, when second booster pump 108 is active and shut-off valve 138 is closed, shut-off valve 138 prevents water from flowing though first backflow preventer 102, allowing a technician to maintain or test first pump 106 and first backflow preventer 102.

As shown in FIGS. 1-3, the components of water booster pump apparatus 110 may be disposed on a frame 118. For example, water inlet pipe 110, both backflow preventers 102, 104, drain 114, both booster pumps 106 and 108, outlet pipe 112, and both controllers 122, 136 may each be affixed to frame 118. Thus, water booster pump assembly 100 may be installed and/or sold as a single unit. In some embodiments, the frame is arranged in a mechanical room such that water inlet pipe 110 may be fluidly coupled to a water source pipe, and water outlet pipe 112 may be fluidly coupled to a water supply pipe. While in some embodiments, frame 118 is made of a metal such as copper or steel, it should be appreciated that in other embodiments, frame 118 is made of plastic or any other suitable material. The frame may be formed as an integral unit or may be made with individual frame components bolted or welded together.

Moreover, in some embodiments, frame 118 includes a hood 120 configured to cover controllers 122, 136. In some embodiments, hood 120 shields at least a portion of one of controllers 122, 136. It should be appreciated that while in some embodiments, hood 120 is permanently fixed to frame 118, hood 120 may also be removably attached to frame 118.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A water booster pump apparatus comprising:

a water inlet pipe;

a water outlet pipe;

a first water pipe branch circuit fluidly coupled to the water inlet pipe and the water outlet pipe, the first water pipe branch circuit including, in series, a first backflow preventer and a first booster pump;

a second water pipe branch circuit fluidly coupled to the water inlet pipe, the second water pipe branch circuit including, in series, a second backflow preventer and a second booster pump; the first and second water pipe branch circuits being arranged in parallel with each other and each disposed between the water inlet pipe and the water outlet pipe; and a crossover branch fluidly coupling the first and second branch circuits at a position downstream of the first and second backflow preventers and upstream of the first and second booster pumps.

2. The water booster pump apparatus of claim 1, wherein a size rating of each of the first and second backflow preventers is less than a size rating of the water inlet pipe.

3. The water booster pump apparatus of claim 2, wherein the water booster pump apparatus is mounted on a frame whereby the water inlet pipe is configured to be connected to a water source pipe and whereby the water outlet pipe is configured to be connected to a water supply pipe.

4. The water booster pump apparatus of claim 1, further comprising a controller configured to selectively turn the first and second booster pumps on and off.

5. The water booster pump apparatus of claim 4, wherein the controller is configured to cycle the first booster pump on and off according to a predetermined schedule.

6. The water booster pump apparatus of claim 5, wherein the controller is configured to cycle the second booster pump on and off according to a predetermined schedule.

7. The water booster pump apparatus of claim 6, wherein the controller is configured to turn the first booster pump on when the controller turns the second booster pump off, and the controller is configured to turn the second booster pump on when the controller turns the first booster pump off.

8. The water booster pump apparatus of claim 7, wherein a size rating of each of the first and second backflow preventers is less than a size rating of the water inlet pipe.

9. The water booster pump apparatus of claim 8, wherein the water booster pump apparatus is mounted on a frame whereby the water inlet pipe is configured to be connected to a water source pipe and whereby the water outlet pipe is configured to be connected to a water supply pipe.

10. The water booster pump apparatus of claim 9, wherein the controller is mounted to the frame and the frame includes a hood to at least partially shield the controller.

11. The water booster pump apparatus of claim 1, wherein the water booster pump apparatus is mounted on a frame whereby the water inlet pipe is configured to be connected to a water source pipe and whereby the water outlet pipe is configured to be connected to a water supply pipe.

12. The water booster pump apparatus of claim 11, further comprising a controller, wherein the controller is configured to selectively turn the first and second booster pumps on and off.

13. The water booster pump apparatus of claim 12, wherein the controller is configured to cycle the first booster pump on and off according to a predetermined schedule.

14. The water booster pump apparatus of claim 13, wherein the controller is configured to cycle the second booster pump on and off according to a predetermined schedule.

15. The water booster pump apparatus of claim 14, wherein the controller is configured to turn the first booster pump on when the controller turns the second booster pump off, and the controller is configured to turn the second booster pump on when the controller turns the first booster pump off.

16. The water booster pump apparatus of claim 1, wherein the crossover branch is configured to balance a volumetric flow rate of the fluid through the first water pipe branch and a volumetric flowrate of the fluid through the second water pipe branch.

17. The water booster pump apparatus of claim 1, further comprising a first controller and a second controller, wherein the first controller operates the first booster pump and the second controller operates the second booster pump.

18. The water booster pump apparatus of claim 17, wherein the first controller is configured to operate the first booster pump in a lead status when the second controller operates the second booster pump in a lag status and operate the first booster pump in a lag status when the second controller operates the second booster pump in a lead status.

19. The water booster pump apparatus of claim 18, wherein the second controller is configured to operate the second booster pump in the lead status when the first controller operates the first booster pump in the lag status and operate the second booster pump in a lag status when the first controller operates the first booster pump in a lead status.

20. The water booster pump apparatus of claim 1, wherein the crossover branch includes a shut-off valve configured to isolate either the first or second pump for maintenance.

21. The water booster pump apparatus of claim 1, wherein the crossover branch includes a shut-off valve configured to isolate either the first or second backflow preventer for testing or maintenance while at least one of the first and second booster pumps is active.

* * * * *